US006446940B1

(12) United States Patent
Berriman et al.

(10) Patent No.: US 6,446,940 B1
(45) Date of Patent: Sep. 10, 2002

(54) FUEL-AIR MIXER

(75) Inventors: Lester P. Berriman, Fullerton, CA (US); John M. Zabsky, Santa Ana, CA (US)

(73) Assignee: KleenAir Systems, Inc., Irvine, CA (US)

( * ) Notice: Subject to any disclaimer, the term of this patent is extended or adjusted under 35 U.S.C. 154(b) by 0 days.

(21) Appl. No.: 09/975,602

(22) Filed: Oct. 10, 2001

Related U.S. Application Data

(60) Provisional application No. 60/249,554, filed on Nov. 17, 2000.

(51) Int. Cl.[7] ..... F02M 7/14; F02M 9/12

(52) U.S. Cl. ..... 261/41.1; 261/41.4; 261/DIG. 12; 261/DIG. 56; 261/78.1

(58) Field of Search ..... 261/41.1, 41.4, 261/78.1, DIG. 56, DIG. 12, DIG. 78, 40

(56) References Cited

U.S. PATENT DOCUMENTS 1,125,069 A * 1/1915 Coulter ..... 261/41.4
1,493,894 A * 5/1924 Reece ..... 261/41.4 X
2,995,349 A * 8/1961 Kennedy, Sr. ..... 261/41.1
3,752,454 A * 8/1973 Korponay ..... 261/41.4
3,931,368 A * 1/1976 Barker et al. ..... 261/DIG. 56
3,965,221 A * 6/1976 Englert et al. ..... 261/DIG. 78
4,133,848 A * 1/1979 Black ..... 261/41.4
4,327,041 A * 4/1982 Baltz et al. ..... 261/41.4
5,716,555 A * 2/1998 Mullican et al. ..... 261/41.4

* cited by examiner

*Primary Examiner*—Richard L. Chiesa
(74) *Attorney, Agent, or Firm*—Leon D. Rosen

(57) ABSTRACT

An apparatus for atomizing liquid fuel while mixing it with air, and varying the amount of each while maintaining a substantially constant fuel/air ratio for the intake manifold of an engine. The apparatus includes a frame (16) forming a passage (14) with a throat (44), with a second wall (56) of the passage being moveable toward and away from a stationary first wall (54) of the passage to vary the cross-section of the passage and thereby vary airflow. A fuel-carrying tube (24) has a proximal end (60) fixed to the first stationary wall and has a distal portion (62) that extends through a bore (64) in the moveable wall and with the moveable wall being slideable around the tube. The tube has at least one aperture (70) for flowing fuel into the passage, with the exposed aperture area being progressively increased as the moveable wall moves away from the stationary wall to flow a progressively increasing amount of fuel into the passage. The moveable wall is moved by a lever (134) that can be moved by the throttle of the engine.

12 Claims, 3 Drawing Sheets

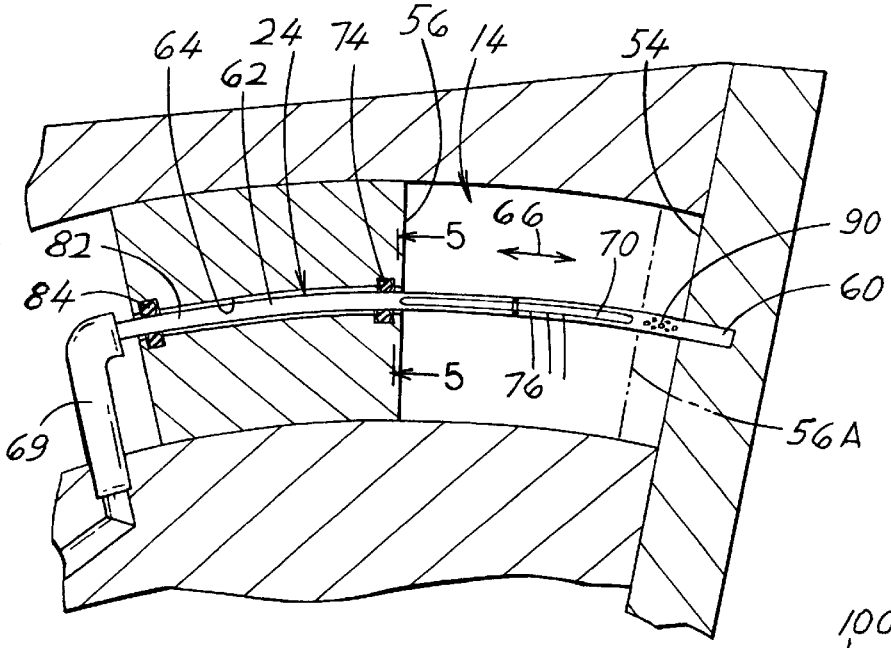
FIG. 4
FIG. 5
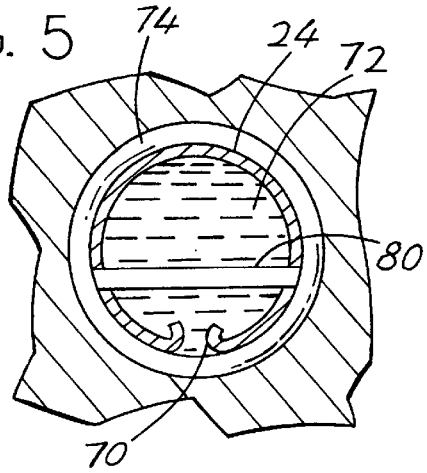
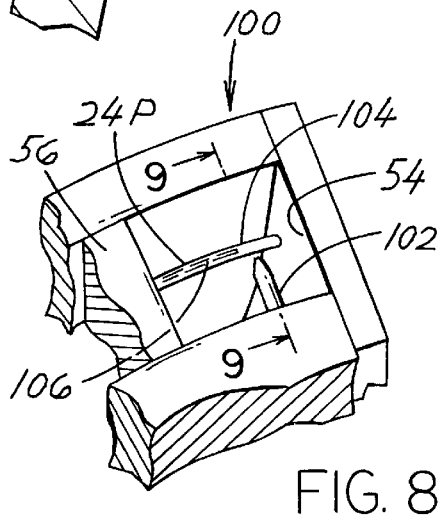
FIG. 8
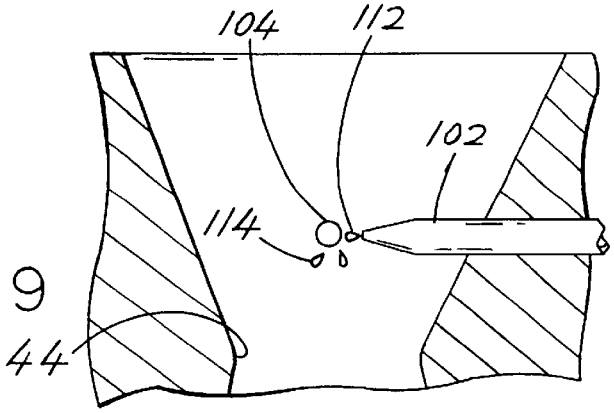
FIG. 9

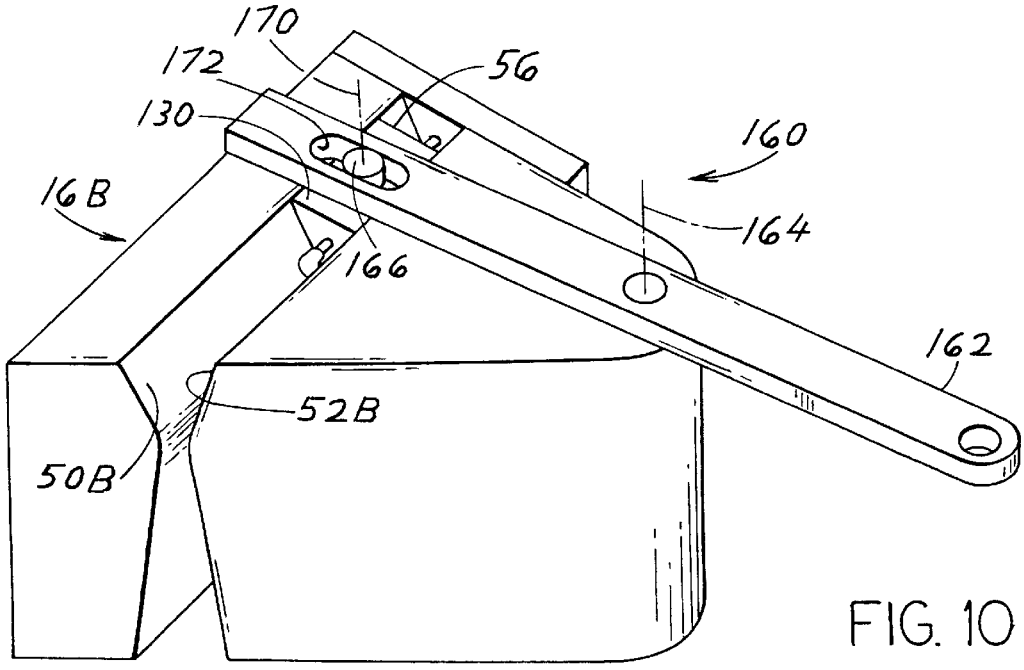
FIG. 10
FIG. 7
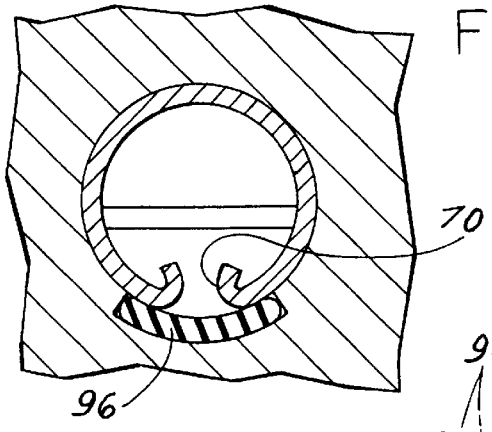
FIG. 6
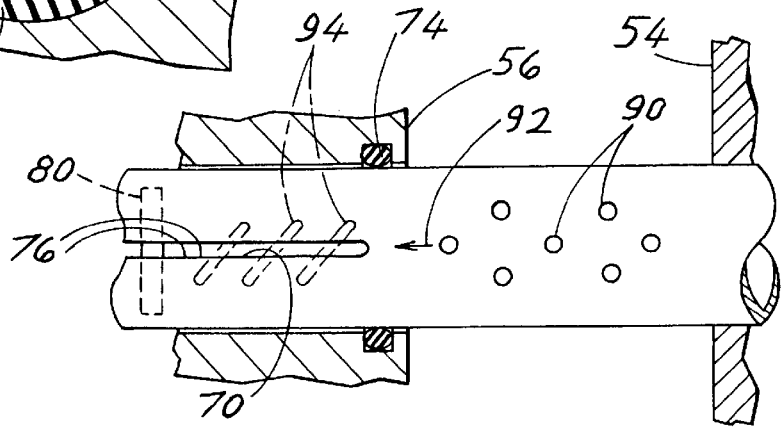

FUEL-AIR MIXER

CROSS-REFERENCE TO RELATED APPLICATION

Applicant claims priority from U.S. Provisional Application Ser. No. 60/249,554 filed Nov. 17, 2000.

BACKGROUND OF THE INVENTION

My earlier U.S Pat. No. 3,965,221 describes apparatus for mixing liquid fuel and air in a constant fuel/air ratio as the throttle of an engine is moved. Fuel is injected into the upstream portion of a passage that has a throat, while air moves through the passage and mixes with the fuel to flow into the manifold of the engine. A moveable wall which moves toward and away from a first stationary wall to vary the cross-sectional area of the passage, holds a needle. The needle has a long tapered end that fits into a fuel-supply tube mounted on the stationary wall. As the moveable wall and needle move away from the stationary wall, the needle progressively opens the end of the fuel-supply tube, to allow an increasing fuel flow into the passage as the cross-sectional area of the passage increases.

In practice, it is difficult to accurately control fuel flow into the passage by a needle that progressively withdraws from the fuel-supply tube. A variable fluid supply device of simple but accurately variable capability, would be of value.

In the above-mentioned patent, the moveable wall is moved by an elongated straight rod that moves in a straight line toward and. away from the stationary wall. In engines, a throttle lever usually pivots, and it can require a relatively complex linkage to connect a pivoting throttle lever to a rod that moves in a straight line, without applying side loads that would tend to tilt the moveable wall. A simple mechanism for moving the moveable wall without applying forces that would skew or tilt it, would be of value.

SUMMARY OF THE INVENTION

In accordance with one embodiment of the present invention, an apparatus is provided for supplying a substantially constant fuel/air ratio to an engine manifold while varying the amount of air as the engine throttle is moved, which includes a fuel supply tube that more accurately varies the amount of supplied fuel in a simple construction. The amount of air flowing through a passage in a frame, is varied by moving a moveable wall on one side of the passage toward and away from a first stationary wall at an opposite second side of the passage. The moveable wall has a bore in it, and the fuel supply tube extends through the bore and across the passage and is fixed to the stationary wall. The tube has numerous aperture portions which are blocked by a seal on the moveable wall. As the moveable wall moves away from the stationary wall, aperture portions are progressively uncovered to inject progressively more fuel into the passage.

A lever means is provided to couple the engine throttle to the moveable wall in a linkage with a minimum number of links. The lever is pivotally mounted on the frame and has an end pivotally coupled to the moveable wall. In one arrangement, the moveable wall moves along an arc of a circle and the lever end is directly pivotally connected to the moveable wall. In another arrangement, the lever end has a slot that can slide relative to the moveable wall while pivoting relative to it.

The novel features of the invention are set forth with particularity in the appended claims. The invention will be best understood from the following description when read in conjunction with the accompanying drawings.

BRIEF DESCRIPTION OF THE DRAWINGS

FIG. 4 is a view taken on line 4—4 of FIG. 3.

FIG. 5 is a view taken on line 5—5 of FIG. 4.

FIG. 6 is a sectional bottom view of a fuel-air mixer of another embodiment of the invention.

FIG. 7 is a sectional view of a portion of a fuel-air mixer of another embodiment of the invention.

FIG. 8 is a partial isometric view of a fuel-air mixer of another embodiment of the invention.

FIG. 9 is a sectional view taken on line 9—9 of FIG. 8.

FIG. 10 is an isometric view of a fuel-air mixer of another embodiment of the invention.

DESCRIPTION OF THE PREFERRED EMBODIMENTS

Figure 3:
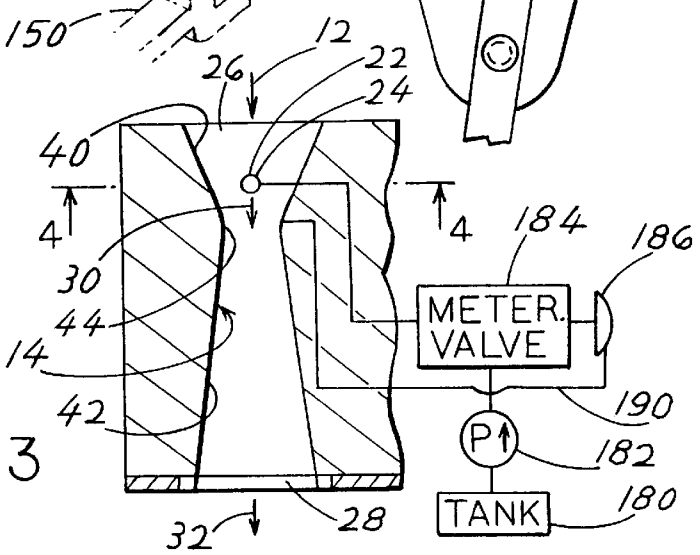
FIG. 3 is a sectional view taken on line 3—3 of FIG. 2.
Figure 1:
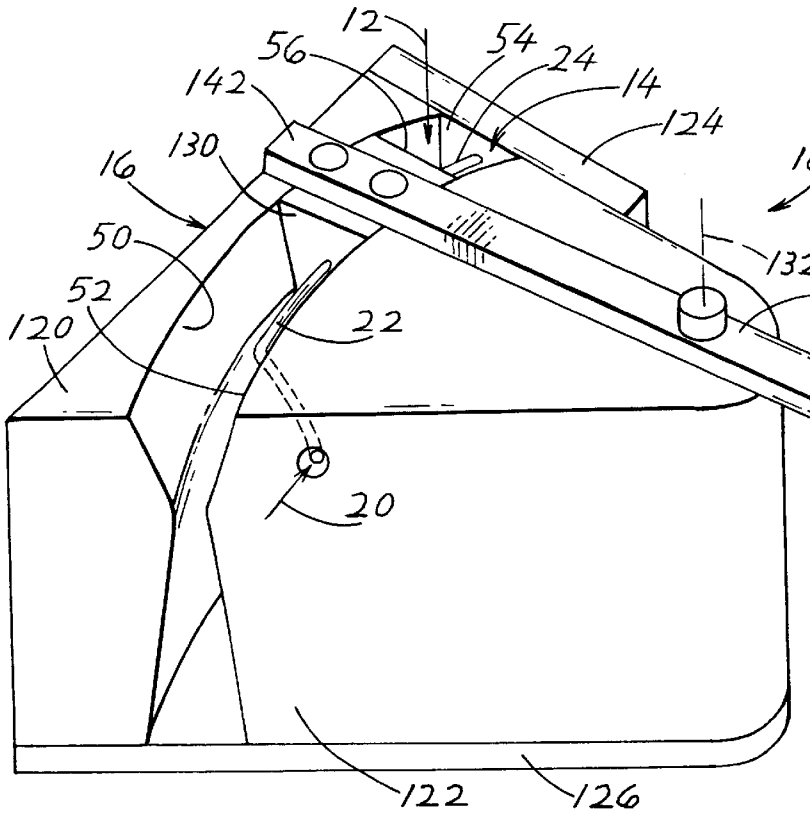
FIG. 1 is an isometric view of a fuel-air mixer of one embodiment of the present invention.

FIG. 1 illustrates a fuel-air mixer 10, which receives air moving along a path 12 from the atmosphere into a passage 14 formed in a frame 16. Liquid fuel is pumped along a path 20 to flow along a conduit 22, and exits from apertures, or perforations, in a tube 24 at the end of the conduit. As shown in FIG. 3, air moving from the passage upstream end 26 along the path 12 encounters fuel moving along the path 30. The fuel and air mix and pass out of the downstream end 28 of the passage 14 and along the path 32 that leads to an intake manifold of an engine. The passage has a converging upstream portion 40, a diverging downstream passage portion 42, and a throat 44 between them. Air moving rapidly through the passage, moves at sonic velocity through the throat, which results in the fuel being atomized and mixing intimately with the air.

Figure 2:
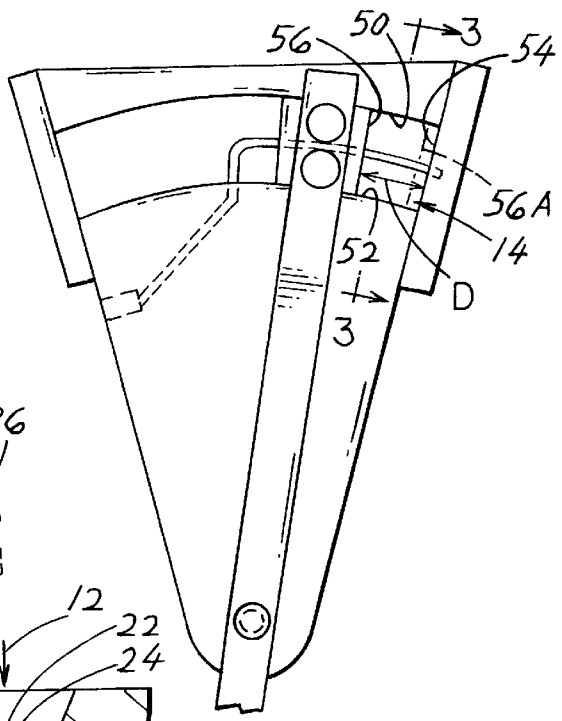
FIG. 2 is a plan view of the mixer of FIG. 1.

As shown in FIG. 2, the passage 14 has opposite sides walls 50, 52 and opposite end walls 54, 56. The second or moveable end wall 56 is moveable toward and away from the first or fixed end wall 54. Such movement of wall 56 varies the cross-sectional area of the passage 14 substantially in proportion to the distance D between the end walls. When the engine is idling, the end wall lies at the position 56A, while when the engine must produce a lot of power the end wall is at the position 56 to increase the cross-section of the passage and thereby allow more air to flow through the passage.

FIG. 4 is a bottom sectional view showing the tube 24 through which liquid fuel is supplied to flow with the air that passes along the passage 14. The tube has a proximal end 60 that is fixed to the first end wall 54 and has a distal portion 62 that lies in a bore 64 in the moveable end wall 56. A distal end 68 is fixed to the frame through pipe 69. As the moveable wall 56 moves in directions 66 toward and away from the first end wall 54, it slides around the tube 24. The tube has an aperture, or perforation 70 in the form of an elongated slot at the lower end of the tube, that extends parallel to the length of the tube. As shown in FIG. 5, liquid fuel 72 that is contained under pressure in the tube 24, exits the tube through the slot 70 to flow into the passage 14 to atomize at the throat 44 (FIG. 3) and mix with air. The slot(s) 70 can be located at any rotational position about the tube axis. In fact, if the slot 70 is on the top (upstream side) of the tube, the fuel may divide into different portions as it flows downstream around the round cross-section of the tube and into the passage.

In the initial position of the end wall at 56A in FIG. 4, the perforation 70 is completely blocked by an O-ring 74. However, as the moveable wall 56 withdraws further from the stationary wall 54, progressively more perforation locations 76 are uncovered by the O-ring and can emit fuel. FIG. 5 shows that a rigidizing pin 80 connects opposite sides of the tube at a location above the slot perforation 70 to prevent the slot from appreciably expanding in width under the pressure of the fuel. FIG. 4 shows that a distal end portion 82 of the tube is sealed by another O-ring 84. The progressive uncovering of the slot as the moveable wall 56 moves away from the stationary wall 54, results in a substantially proportional increase in the rate of fuel ejection into the passage as the cross-sectional area of the passage increases.

FIG. 4 shows the second or moveable wall in its idle position of 56A wherein it is closest to the first wall 54 and the engine is idling. Then, the only fuel is released through holes 90. Although the slot-shaped perforation 70 is shown, with perforation locations 76 spaced along the direction of movement 92 of the moveable wall, other perforation arrangements can be used. FIG. 6 shows another perforation arrangement 94 for emitting progressively more fuel as the length of the passage between the walls 54, 56 progressively increases.

Although an elastomeric seal at 74 of the O-ring shape is generally preferred, FIG. 7 shows that a different shape of elastomeric seal 96 can be used to seal the slot 70.

FIG. 8 illustrates a mixer 100 that is similar to that of FIGS. 1–7, except that it has a different arrangement for supplying fuel during idling of an engine, when the moveable end wall 56 would be closest to the first end wall 54. In this arrangement, fuel is applied to a nozzle 102 that directs a stream of fuel against an unperforated proximal end portion 104 of a fuel-carrying tube 24P. The tube 24P has a slot 106 in its lower side. The slot proximal end 110 is not exposed when the engine is idling and the moveable wall 56 is close to the stationary wall 54. Instead, fuel passes through the nozzle 102 and strikes the tube proximal end part 104 to help break up the fuel droplets. FIG. 9 shows emitted fuel 112 which strikes the tube proximal end part 104 and which is broken up by the tube into the droplets 114. Due to the air moving at sonic velocity through the throat 44, the fuel droplets are atomized to more thoroughly mix with the air. Fuel from the idle nozzle 102 continues when the slot 106 of FIG. 8 begins to be uncovered as the moveable wall moves away from the fixed wall.

Referring to FIG. 1, it can be seen that the frame 16 includes opposite frame side parts 120, 122 that form the opposite side walls 50, 52 and a part 124 that forms the fixed or stationary end wall 54. A base 126 holds the walls together. The moveable wall 56 is formed from another part 130 that is slideable between the opposite side walls. The opposite side walls 50, 52 are curved about a longitudinal axis 132 that passes through the frame 16. A lever 134 has a middle 135 pivotally mounted on the frame on the axis 132. The lever has one end 136 designed to be connected to a throttle, as by the throttle 150 connected by a shaft extending through a hole 140 in the lever end. The opposite end 142 of the lever is fixed to the part 130 that forms the moveable end wall 56. This arrangement permits a simple linkage between the throttle lever 150 and the moveable part 130. Also, the lever 134 fixes the orientation, as well as the position, of the moveable part 130 of the air and fuel mixing passage. An additional lever lying at the downstream end of the passage can be fixed to the downstream end of the movable wall part 130 and pivotally mounted on the downstream end of the frame side part 122. Such additional lever can be fixed to lever 134.

FIG. 10 shows another mixer 160 where a lever 162 is pivotally connected at 164 to the frame 16B, but is both slideably and pivotally coupled to the moving part 130 that forms the moveable wall 56. A roller 166 is pivotally connected to the moveable part 130 about an axis 170. In addition, the lever has a slot 172 with sides that closely straddle the roller 166. As the lever 162 pivots about the axis 164, the lever moves the moveable part 130 along straight opposite side walls 50B, 52B of the frame. In this case, applicant relies upon the walls 50B, 52B to maintain the orientation of the moveable wall 130 as it slides.

FIG. 3 shows parts of the complete system, which includes a fuel tank 180, and a pump 182 for pumping fuel through a metering valve 184 into the conduit 22 that includes the tube 24 with one or more perforations. A diaphragm 186 which senses passage air pressure upstream of the throat 44, through a line 190 opening to the passage at 192, varies the opening of the metering valve 184 in accordance with variations in atmospheric pressure. The fuel air ratio can be varied slightly. Although FIG. 3 shows a pumped fuel system, the fuel can be gravity fed into the fuel-carrying tube.

It is possible to have the first end wall 54 move away from the second end wall 56 instead of being stationary, although this is not preferred. If the first end wall moves, then it is possible for the fuel tube 24 to slide relative to the frame, although this is also not preferred. The fuel tube proximal end can be fixed to any part of the frame but is preferably fixed to a stationary first end wall 54.

Thus, the invention provides apparatus that flows a fuel/air mixture through a passage of variable cross-section, but with a substantially constant fuel/air ratio, that includes a reliable apparatus for flowing a variable amount of fuel into the passage. As a moveable wall moves away from a first wall (which is preferably fixed) the cross-section of the passage varies proportional to movement of the moveable wall. A fluid dispensing tube has a proximal end fixed to the first wall and a proximal end portion with one or more perforations through which fluid can flow into the passage. The perforation locations from which fluid is emitted, are spaced along the length of the tube, and are progressively uncovered to flow progressively more fuel into the passage, as the moveable wall moves away from the first fixed wall. The perforation locations are preferably locations along an elongated slot that extends along the length of the tube. Opposite side walls of the passage, which lie at opposite sides of the moveable end wall, can be curved about an axis located on the frame that forms the stationary walls, and the moveable wall can be moved by a lever that is pivotally connected to the frame and that is fixed to the moveable wall. Alternatively, the lever can have a slot so it can slide and pivot with respect to the moveable wall.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for producing a combustible air-fuel mixture for an engine, which includes a frame forming a passage through which air can flow in a downstream direction, said passage having opposite passage side walls and opposite passage end walls wherein one end wall is stationary and the other is moveable, said movable end wall being moveable closer and further from said stationary end wall to vary the cross-sectional area of the passage, said moveable end wall having a bore extending substantially parallel to movement of said moveable end wall, and including a fuel-carrying fuel tube slideably projecting into said bore but fixed with respect to said frame, so as said moveable end wall moves progressively away from said first end wall, a progressively increasing length of said fuel-carrying tube is progressively exposed to said passage, with said progressively increasing length of fuel tube having at least one perforation with perforation areas exposed to said passage that progressively increase in area as said moveable second end wall moves away from said first end wall, characterized by:

an elastomeric seal that is fixed to said moveable wall and that seals against said fuel tube to prevent the escape of fuel,from a perforation location into said passage until said location has been uncovered by sufficient movement of said moveable end wall away from said fixed end wall.

2. The apparatus described in claim 1, wherein:

said fuel tube is elongated and said perforation comprises an elongated slot extending along part of the length of said tube.

3. The apparatus described in claim 2 wherein:

said fuel tube has opposite tube sides at opposite sides of said slot, and has a pin extending between said tube sides to fix the separation of said tube sides.

4. The apparatus described in claim 1 wherein:

said passage side walls are curved about an axis extending parallel to said upstream and downstream directions;

a portion of said fuel tube that lies in said movable end wall is also curved about said axis, and including a lever pivotally coupled to the frame and to the moveable end wall.

5. The apparatus described in claim 1 wherein:

said passage side walls are curved about a first axis that extends parallel to said upstream and downstream directions; and including a lever having a first lever part pivotally connected to said frame about said first axis, and having a second lever part that is fixed to said moveable second end wall.

6. The apparatus described in claim 1 wherein:

said passage side walls are straight in directions that are parallel to movement of said moveable wall; and including a lever having first and second lever parts pivotally coupled to locations respectively on said frame and on said moveable wall about parallel axes that are parallel to said downstream direction, with one of said lever parts also being slideable with respect to one of said locations.

7. The apparatus described in claim 1, wherein:

said fuel-carrying tube has an initial portion that lies adjacent to said first wall; and including an idle tube that has an idle nozzle end that is directed at said initial portion of said fuel-carrying tube, to allow said fuel-carrying tube to disperse fuel directed at it from said idle nozzle.

8. The apparatus described in claim 1 wherein:

said fuel tube has proximal and distal ends each fixed to said frame, with said fuel tube proximal end fixed to said stationary end wall, said bore extending completely through said moveable wall and said fuel tube extending completely through said bore.

9. Apparatus for producing a combustible air-fuel mixture to power an engine, comprising:

a frame forming a through passage that has longitudinally spaced upstream and downstream passage parts, opposite passage side walls, and first and second opposite passage end walls, said second end wall being moveable closer and further from said first end wall to vary the cross-sectional area of the passage, said moveable second end wall has walls forming a bore extending largely parallel to movement of said second end wall away from said first end wall and including a fuel-carrying fuel tube slideably projecting through said bore, said tube projecting through said passage and fixed to said frame, said fuel tube having at least one aperture that is uncovered to emit progressively more fuel into said passage as said movable second end wall moves away from said first end wall, characterized by:

an elastomeric seal mounted on said moveable wall and sealed to said fuel tube and with respect to the walls of said bore.

10. The apparatus described in 9 claim wherein:

said walls forming a bore forms an internal groove lying at an end of said bore that is closest to said first wall, said elastomeric seal comprising an O-ring lying in said groove.

11. Apparatus for producing a combustible air-fuel mixture to power an engine, which includes a frame forming a through passage that has longitudinally spaced upstream and downstream passage parts, opposite passage side walls, and opposite passage first and second end walls, said second end wall being moveable closer and further from said first end wall to vary the cross-sectional area of the passage, characterized by:

a lever pivotally coupled to said frame and coupled to said moveable second end wall to move said moveable second end wall toward and away from said first end wall;

said opposite side walls are each curved about a longitudinally-extending first axis, and said lever is pivotally mounted on said frame about said first axis and has a lever end that is fixed to said moveable wall to control its orientation as well as its position.

12. The apparatus described in claim 11 wherein:

said moveable second end wall has a bore; and including a fuel tube having a proximal end fixed to said first end wall, said fuel tube extending across said passage and completely through said bore in said moveable second end wall to said frame, with said fuel tube having a plurality of aperture portions that are progressively uncovered to flow progressively more fuel into said passage as said moveable second end wall moves progressively further from said first end wall.

* * * * *